US010737481B2

(12) United States Patent
Zlatin et al.

(10) Patent No.: US 10,737,481 B2
(45) Date of Patent: Aug. 11, 2020

(54) PLATE CYLINDER WITH PLATE LOCKUP MECHANISM AND RELATED PRINTING PRESS AND METHOD

(71) Applicant: Goss International Americas, Inc., Durham, NH (US)

(72) Inventors: Lev Zlatin, Portsmouth, NH (US); Michael Lemelin, Dover, NH (US)

(73) Assignee: MANROLAND GOSS WEB SYSTEMS GMBH, Durham, NH (US)

( * ) Notice: Subject to any disclaimer, the term of this patent is extended or adjusted under 35 U.S.C. 154(b) by 45 days.

(21) Appl. No.: 15/715,612

(22) Filed: Sep. 26, 2017

(65) Prior Publication Data

US 2019/0001659 A1 Jan. 3, 2019

Related U.S. Application Data

(60) Provisional application No. 62/528,349, filed on Jul. 3, 2017.

(51) Int. Cl.
*B41F 3/54* (2006.01)
*B41F 27/12* (2006.01)

(52) U.S. Cl.
CPC ..... *B41F 3/54* (2013.01); *B41F 27/125* (2013.01); *B41F 27/1212* (2013.01)

(58) Field of Classification Search
CPC ..... B41F 3/54
USPC ..... 101/383
See application file for complete search history.

(56) References Cited

U.S. PATENT DOCUMENTS 3,757,690 A * 9/1973 Skiera ..... B41F 27/125 101/415.1
4,068,586 A * 1/1978 Frey ..... B41F 27/125 101/415.1
5,107,763 A * 4/1992 Gevis ..... B41F 27/1281 101/382.1
5,218,906 A * 6/1993 Doersam ..... B41F 27/125 101/378
5,413,042 A * 5/1995 Weiss ..... B41F 27/1218 101/378
5,503,072 A * 4/1996 Schneider ..... B41F 27/125 101/378

(Continued)

FOREIGN PATENT DOCUMENTS

FR 2898297 A1 9/2007

*Primary Examiner* — Anthony H Nguyen
(74) *Attorney, Agent, or Firm* — Davidson, Davidson & Kappel, LLC; Jennifer L. O'Connell

(57) ABSTRACT

A plate cylinder includes a plate cylinder body having a longitudinally-extending first hole and a longitudinally extending plate-receiving gap connected to the first hole, the plate cylinder body having a longitudinally-extending second hole parallel to the first hole; and a lock-up mechanism including: a torsion bar extending in the longitudinally extending hole and having a surface for contacting an end of a plate located in the gap; a swing bar extending longitudinally in the second hole and being movable perpendicular to a longitudinal direction due to the second hole being oversized compared to dimensions of the swing bar within the second hole; a lever connecting the swing bar and the torsion bar, the torsion bar being rotatable as the swing bar moves within the second hole; and an activator for rotating the torsion bar. A printing press and methods are also provided.

5 Claims, 7 Drawing Sheets

(56) References Cited

U.S. PATENT DOCUMENTS

| | | | | | |
|---|---|---|---|---|---|
| 5,598,780 | A | | 2/1997 | Marmin et al. | |
| 5,644,984 | A | * | 7/1997 | Puschnerat | B41F 27/125 101/409 |
| 5,778,786 | A | * | 7/1998 | Metrope | B41F 27/1243 101/415.1 |
| 5,791,244 | A | | 8/1998 | Tognino | |
| 5,921,183 | A | | 7/1999 | Jones | |
| 6,047,641 | A | | 4/2000 | Chagnon | |
| 6,164,205 | A | * | 12/2000 | Metrope | B41F 27/125 101/378 |
| 6,378,430 | B1 | * | 4/2002 | Eighmy | B41F 27/1237 101/378 |
| 6,463,852 | B1 | * | 10/2002 | Chagnon | B41F 27/1212 101/378 |
| 6,612,239 | B2 | * | 9/2003 | Reichel | B41F 27/1243 101/378 |
| 2007/0137508 | A1 | * | 6/2007 | Lepinay | B41F 27/1243 101/415.1 |

* cited by examiner

PLATE CYLINDER WITH PLATE LOCKUP MECHANISM AND RELATED PRINTING PRESS AND METHOD

This claims the benefit of Provisional U.S. Patent Application No. 62/528,349, filed Jul. 3, 2017 and hereby incorporated by reference herein.

The present invention relates generally to printing presses and more specifically to a lock-up device for a plate of a plate cylinder of a printing press.

BACKGROUND

Various plate cylinder lock-up mechanisms are known.

U.S. Pat. Nos. 5,791,244 and 5,921,183 disclose a lock-up mechanism and both are hereby incorporated by reference herein.

The M600 plate cylinder lockup mechanism from GOSS uses bladder activation.

SUMMARY OF THE INVENTION

Bladders however have a short life expectancy and require costly repair.

The present invention provides a plate cylinder comprising:

a plate cylinder body having a longitudinally-extending first hole and a longitudinally extending plate-receiving gap connected to the first hole, the plate cylinder body having a longitudinally-extending second hole parallel to the first hole; and a lock-up mechanism including:

a torsion bar extending in the longitudinally extending hole and having a surface for contacting an end of a plate located in the gap;

a swing bar extending longitudinally in the second hole and being movable perpendicular to a longitudinal direction due to the second hole being oversized compared to dimensions of the swing bar within the second hole;

a lever connecting the swing bar and the torsion bar, the torsion bar being rotatable as the swing bar moves within the second hole; and an activator for rotating the torsion bar.

The present invention provides a stable construction and due to the oversized second hole and its interaction with the swing bar, a defined, safe and stable lock-up can be provided. The two linkage mechanism gives greater mechanical advantage than a single linkage.

The activator preferably is an air cylinder. Air cylinders have longer life, lower cost and can be easily replaced. The air cylinder can be retracted during printing process leading to increased life of the air cylinder.

The lock-up mechanism preferably has a spring, most preferably a torsion spring, that forces the torsion bar toward the lock-up position, and the swing bar is in contact with an upper surface of the second hole. When the activator is activated, the lever rotates until a stop hits the cylinder body. The lever pushes down the swing bar in the second hole and rotates the torsion bar against the action of the spring to a release position for the printing plate end.

An offset printing press comprising the plate cylinder and a method for locking up the plate is also provided.

DETAILED DESCRIPTION

Figure 1:
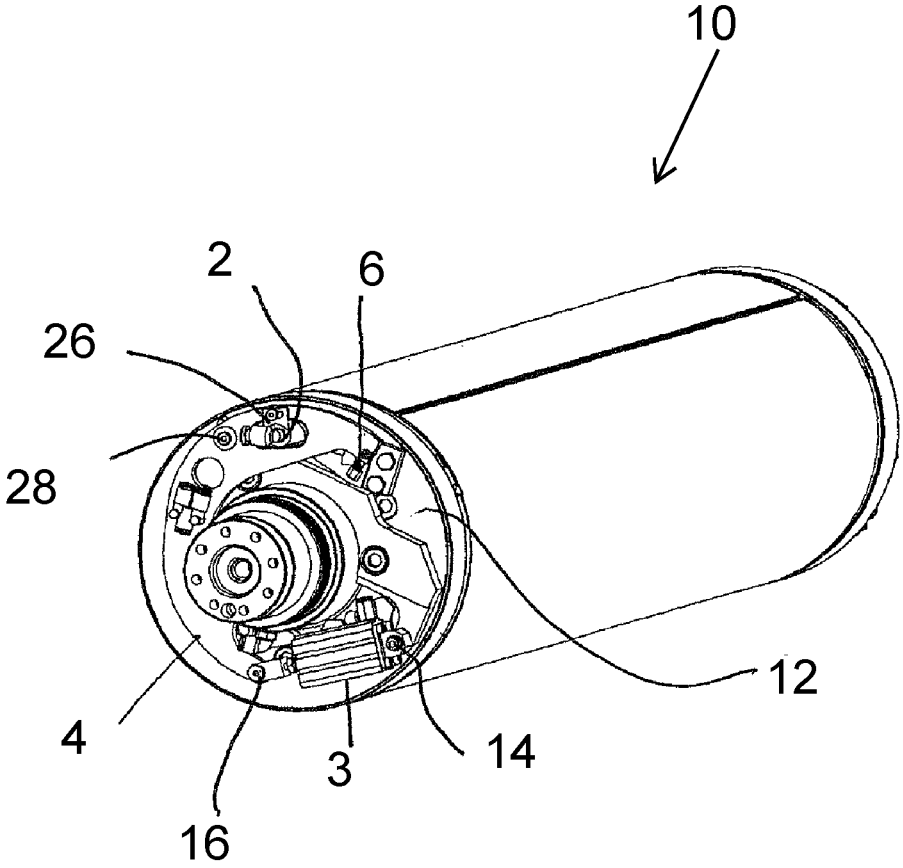
FIG. 1 shows a perspective view of the plate cylinder of the present invention.
Figure 2:
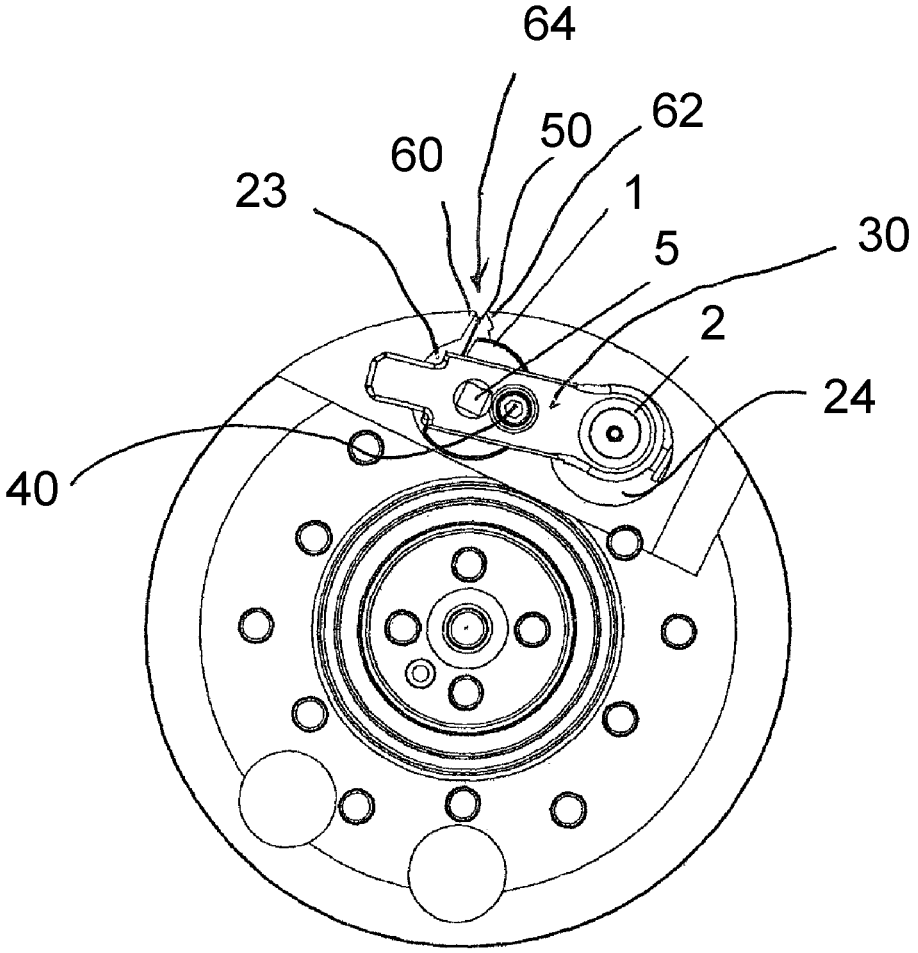
FIG. 2 shows an opposite end side view showing the connection of the swing bar to the torsion bar via the lever.
Figure 7:
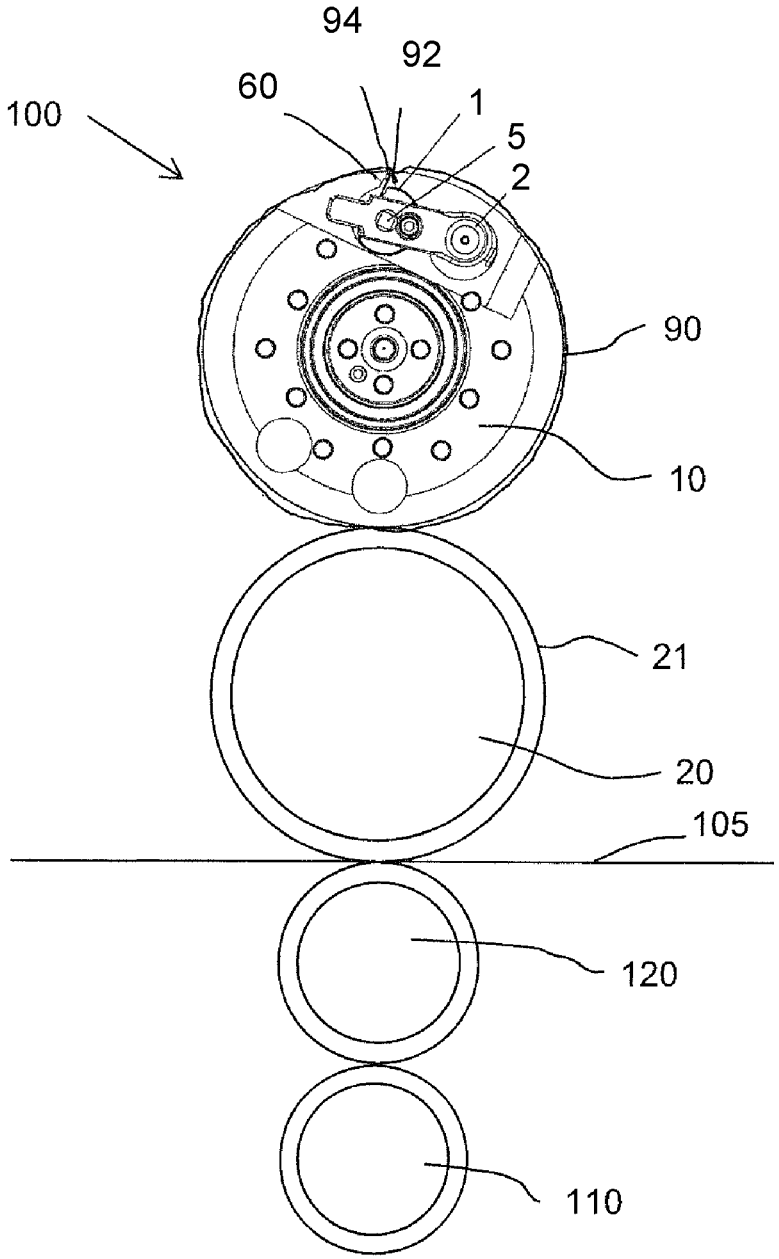
FIG. 7 shows, schematically, an offset printing press of the present invention.

As shown in FIGS. 1 and 2, an embodiment of a plate cylinder 10 of the present invention, which can interact with a blanket cylinder 20 of an offset printing press 100 (FIG. 7). Plate cylinder 10 includes, as shown in FIG. 2, a torsion bar 1 and a swing bar 2. As shown in FIG. 1, plate cylinder 10, on one axial end also includes an air cylinder 3, and a lever 4. Air cylinder 3 is fixed to the plate cylinder body 12 at one end at connection 14, and at the other end to lever 4 via connection 16.

As shown in FIG. 2, torsion bar 1 is located inside a first longitudinally-extending hole of the plate cylinder body and can rotate. Swing bar 2 is in a longitudinally-extending oversized second hole 24 in the plate cylinder body. Swing bar 2 can rotate around the torsion bar. Motion is limited by oversized hole 24. When air cylinder 3 is not activated, a longitudinally-extending torsion spring 5 applies force, rotating swing bar 2 until swing bar 2 hits the top of the second hole as shown in FIG. 2. The curved surface of the swing bar 2 interacts with the second hole 24 and provides a stable rest area. The outer radius of the swing bar 2 thus is smaller than the inner radius of the second hole 24. When air cylinder 3 is activated, the air cylinder 3 rotates lever 4 until a stop 6 (shown in FIG. 1) hits the cylinder body or an item fixed to the cylinder body. Lever 4 is connected to an end of swing bar 2, for example at a connection 26. When rotated, for example about a pivot point 28, lever 4 pushes down swing bar 2 via connection 26. An arm 30 connected to swing bar 2, and to torsion bar 1 via connection 40, rotates torsion bar 1 against the force of torsion spring 5. Torsion bar 1 thus moves to a printing plate release position, where a plate attachment device or finger 50 moves away from a plate attachment edge 60 of plate cylinder body 12. Cylinder 10 has a second attachment edge 62 which defines a circumferential gap 64. When the air cylinder is deactivated, the torsion spring 5 is released, rotating all components, including swing bar 2 and torsion bar 1 to the original location (printing plate locked position) as shown in FIG. 2. The plate insertion and attachment procedure is described below.

Figure 3:
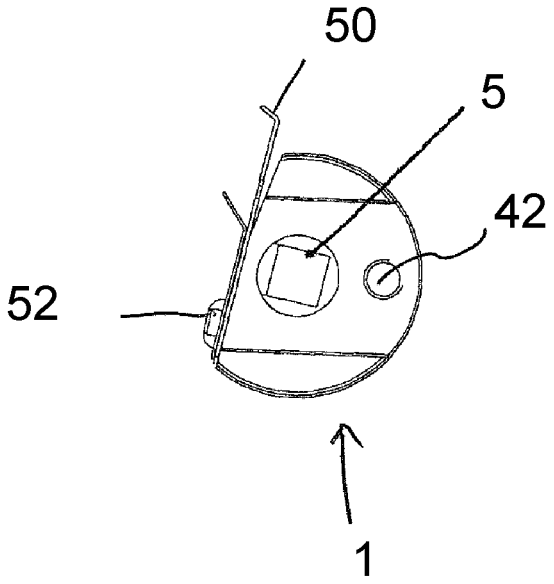
FIG. 3 shows the torsion bar in side view.

FIG. 3 shows the torsion bar 1 in side view, with spring 5 and a connection point 42 for connection 40. Spring 5 can for example be any type of torsion spring for loading torsion bar 1 in the counterclockwise direction as shown in FIG. 3. Finger 50 can be connected for example to a flat, axially extending surface of bar 1, via a plurality of connectors 52, as shown in FIGS. 3 and 4.

Figure 4:
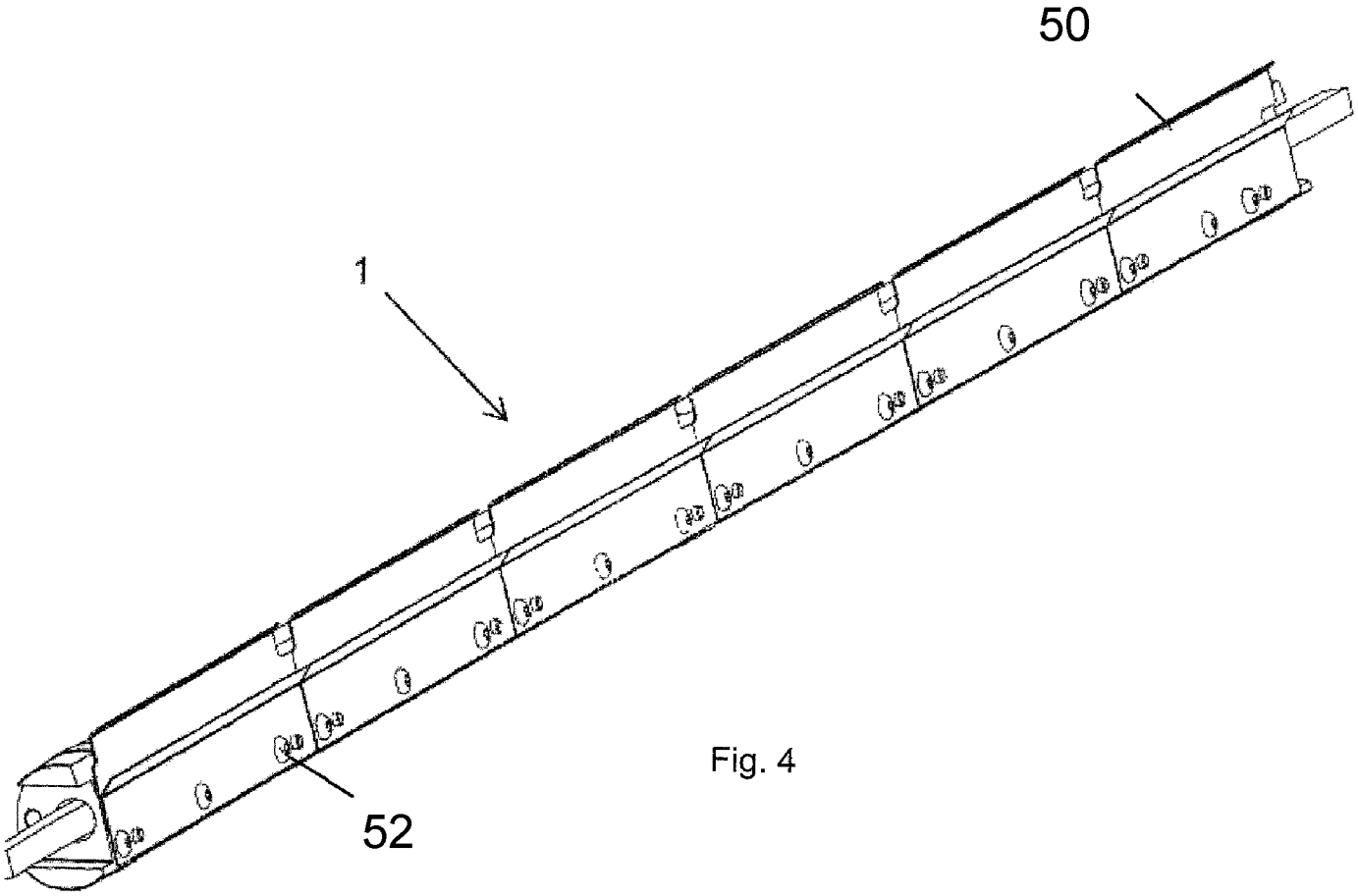
FIG. 4 shows the torsion bar in perspective view.

FIG. 4 shows the torsion bar 1 in perspective view. As shown a plurality of axially side-by-side fingers 50 can be provided and attached with connectors 42.

Figure 5:
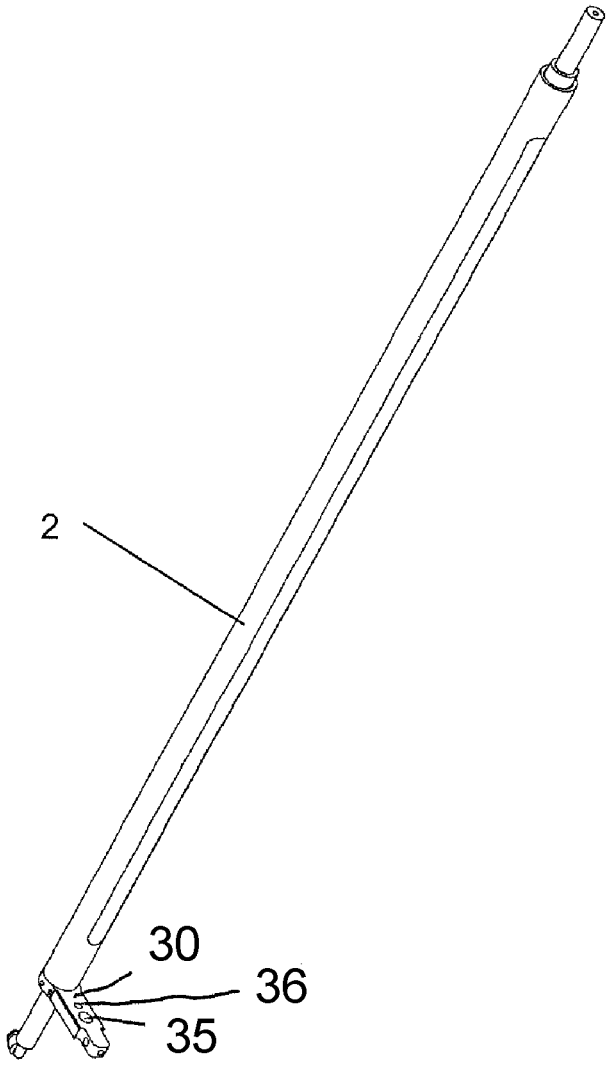
FIG. 5 shows the swing bar in perspective view.

FIG. 5 shows the swing bar 2 in perspective view, with arm 30 connected art one end. As shown arm 30 has a receptacle 35 for torsion spring 5 to fit through freely and also a connection receptacle for connection 40. A bolt or screw for example thus can connect arm 30 to torsion bar 1 at connection 40.

Figure 6:
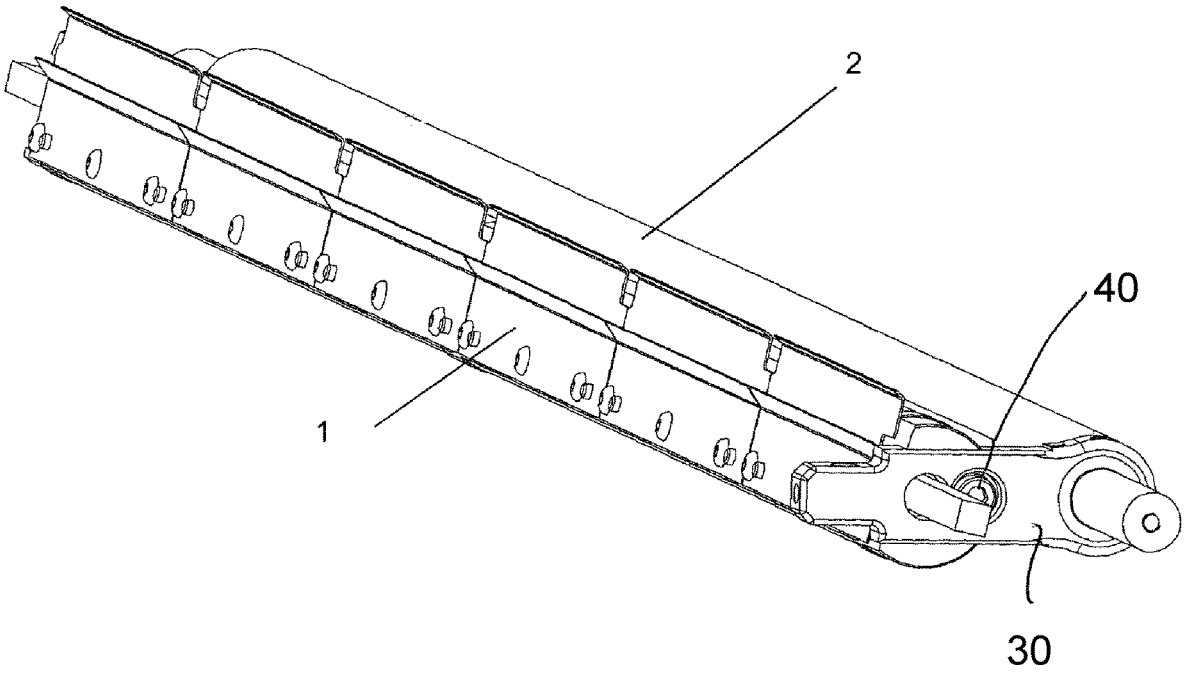
FIG. 6 shows the torsion bar and swing bar connected in a perspective view from the end shown in FIG. 2.

FIG. 6 shows the torsion bar 1 and swing bar 2 connected in a perspective view from the end shown in FIG. 2, via arm 30 and connection 40.

FIG. 7 shows, schematically, an offset printing press 100 of the present invention, with plate cylinder 10, blanket cylinder 20 with for example a sleeve shaped blanket 21, and a printing plate 90 attached to plate cylinder 10. A similarly constructed opposing blanket cylinder 120/plate cylinder 110 pair can be located on an opposite side of a web 105.

Insertion of plate 90 operates as follows. A bent end of printing plate 90 is inserted to contact plate attachment edge 62 (FIG. 2) and then the cylinder 10 is rotated so that plate 90 wraps around cylinder 10. Air cylinder 3 is activated so that lock-up device is released and fingers 50 move away from plate attachment edge 60 via swing bar 2 moving downwardly. A second bent end of plate 90 is then inserted between edge 60 and fingers 50, and air cylinder 3 deactivated so that fingers 50 lock the plate 90 in place against edge 60.

What is claimed is:

1. A plate cylinder comprising:

a plate cylinder body having a longitudinally-extending first hole and a longitudinally extending plate-receiving gap connected to the first hole, the plate cylinder body having a longitudinally-extending second hole parallel to the first hole; and a lock-up mechanism including:

a torsion bar extending in the longitudinally extending first hole and having a surface for contacting an end of a plate located in the gap;

a swing bar extending longitudinally in the second hole and being movable perpendicular to the longitudinal direction due to the second hole being oversized compared to dimensions of the swing bar within the second hole;

an arm connecting the swing bar and the torsion bar, the torsion bar being rotatable as the swing bar moves within the second hole;

an activator; and a lever connecting the activator to the swing bar, the activator rotating the lever to move the swing bar thereby rotating the torsion bar.

2. The plate cylinder as recited in claim 1 wherein the activator is an air cylinder.

3. The plate cylinder as recited in claim 1 wherein the lock-up mechanism has a spring forcing the torsion bar toward a lock-up position, the swing bar being in contact with an upper surface of the second hole in the lock-up position.

4. The plate cylinder as recited in claim 3 wherein, when the activator is activated, the lever rotates until a stop hits the plate cylinder body, the torsion bar being rotated against action of the spring to a release position, the swing bar being out of contact with the upper surface in the release position.

5. An offset printing press comprising the plate cylinder as recited in claim 1 and a blanket cylinder.

* * * * *